US010830492B2

(12) United States Patent
Fabrizio

(10) Patent No.: US 10,830,492 B2
(45) Date of Patent: Nov. 10, 2020

(54) ULTRA-LOW FLOW ELECTRIC TANKLESS WATER HEATER

(71) Applicant: Chronomite Laboratories, Inc., City of Industry, CA (US)

(72) Inventor: Edward Vincent Fabrizio, Rancho Cucamonga, CA (US)

(73) Assignee: Chronomite Laboratories, Inc., City of Industry, CA (US)

( * ) Notice: Subject to any disclaimer, the term of this patent is extended or adjusted under 35 U.S.C. 154(b) by 554 days.

(21) Appl. No.: 15/488,043

(22) Filed: Apr. 14, 2017

(65) Prior Publication Data

US 2018/0299165 A1 Oct. 18, 2018

(51) Int. Cl.

| | |
|---|---|
| ***F24H 1/10*** | (2006.01) |
| ***F24H 9/20*** | (2006.01) |
| ***H05B 1/02*** | (2006.01) |

(52) U.S. Cl.

CPC ..... *F24H 1/102* (2013.01); *F24H 1/103* (2013.01); *F24H 9/2028* (2013.01); *H05B 1/0283* (2013.01)

(58) Field of Classification Search

None

See application file for complete search history.

(56) References Cited

U.S. PATENT DOCUMENTS 4,762,980 A 8/1988 Insley
4,900,896 A * 2/1990 Maus ..... F24H 9/2028 200/81.9 M
4,960,976 A 10/1990 Insley
5,216,743 A 6/1993 Seitz
5,325,822 A 7/1994 Fernandez
5,504,306 A 4/1996 Russell et al.
5,866,880 A 2/1999 Seitz et al.
6,080,971 A 6/2000 Seitz et al.
6,175,689 B1 * 1/2001 Blanco, Jr. ..... F24H 1/102 392/474
6,240,250 B1 * 5/2001 Blanco, Jr. ..... F24H 1/102 392/474
6,246,831 B1 6/2001 Seitz et al.
6,909,843 B1 6/2005 Fabrizio
7,567,751 B2 7/2009 Fabrizio
7,773,868 B2 8/2010 Moore
7,779,790 B2 * 8/2010 Fabrizio ..... F24H 9/2028 122/4 A
8,064,758 B2 11/2011 Fabrizio
8,104,434 B2 1/2012 Fabrizio
8,280,236 B2 10/2012 Fabrizio
(Continued)

*Primary Examiner* — Ibrahime A Abraham
*Assistant Examiner* — Elizabeth M Sims
(74) *Attorney, Agent, or Firm* — Eric J. Sosenko; Jonathan P. O'Brien; Honigman LLP

(57) ABSTRACT

An electric tankless water heater for heating a continuous supply of water. The electric tankless water heater includes a heater assembly having a water inlet, a water outlet and a heating chamber defining a water flow path there between. A flow sensing device is coupled to the water flow path and configured to detect an ultra-low flow condition of water within a heating chamber of the heater assembly. In response to the detection of an ultra-low flow condition, or higher flow conditions, a controller regulates the amount of electrical current flowing through to achieve the desired temperature of water at the water outlet.

12 Claims, 4 Drawing Sheets

(56) References Cited

U.S. PATENT DOCUMENTS

| | | | | |
|---|---|---|---|---|
| 2005/0185942 | A1 | 8/2005 | Fabrizio | |
| 2009/0285569 | A1 | 11/2009 | Fabrizio | |
| 2010/0278519 | A1 | 11/2010 | Fabrizio | |
| 2011/0013893 | A1 | 1/2011 | Fabrizio | |
| 2014/0229022 | A1* | 8/2014 | Deivasigamani .... | G05D 7/0629<br>700/282 |

* cited by examiner

ULTRA-LOW FLOW ELECTRIC TANKLESS WATER HEATER

BACKGROUND OF THE INVENTION

1. Field of the Invention

The present disclosure generally relates to an electric tankless water heater. More specifically, the present disclosure relates to an ultra-low flow electric tankless water heater system.

2. Description of Related Art

Tankless water heaters are used to increase the temperature of water supplied from a water source. Such water heaters often include an inlet, an outlet, a conduit for transporting water from the inlet to the outlet, and at least one heater element for increasing the temperature of the water prior to the water exiting the outlet.

In order to achieve a desired temperature of water exiting the outlet, it is often necessary to control the electrical energy supplied to one or more heater elements. The heating element(s) must be of sufficient wattage to maintain the desired outlet water temperature at the maximum flow rate of the tankless water heater. Obviously, if the wattage is insufficient, the temperature of water provided at the maximum flow rate will not be the desired temperature. However, with high wattage heating element(s), supplying hot water at very low flow rates is not possible without the risk of overheating the tankless water heater. For this reason, the heating element(s) is not activated until a minimum flow rate is detected. This minimum flow rate is, accordingly, a flow rate at which overheating will not occur based on the wattage of the heating elements and/or the control thereof.

Detecting low flow rates also has its own difficulties. Typically, expensive and complicated flow sensors are required.

While existing electric tankless water heaters have proven acceptable for their intended purpose, a continuous need for improvement remains in the relevant art.

BRIEF SUMMARY

In satisfying the above need, as well as overcoming the enumerated drawbacks and other limitations of the related art, the present disclosure provides an electric tankless water heater with ultra-low flow activation, and more specifically, one with a reliable and cost effective flow sensing device that can detect ultra-low flow. In accordance with the present invention, ultra-low flow activation (such as 0.1 to 0.3 gallons per minute (GPM)) can be achieved without requiring an expensive and/or complicated flow sensor.

In one aspect, the invention provides a tankless water heater for heating a continuous supply of water. The tankless water heater includes a heater assembly having a water inlet, a water outlet and a heating chamber including a housing defining a water flow path between the water inlet and the water outlet. A temperature sensor is configured to measure the temperature of water flowing through the heating chamber of the heater assembly. A flow sensing device is configured to measure a flow condition of water through a flow path within the heater assembly. The flow sensing device includes a sensing chamber coupled to the flow path and configured to induce a relative negative pressure in the sensing chamber at an ultra-low flow rate. Coupled to the flow sensing device is a switch. Control circuitry coupled to the switch, the temperature sensor and one or more heating elements located within the flow path, regulates the amount of electrical current flowing through the heating elements in response to the flow condition measured by the flow sensing device.

In another aspect, the flow sensing device includes a pressure chamber isolated from the sensing chamber.

In a further aspect, a diaphragm separates the pressure chamber from the sensing chamber.

An additional aspect, portions of the housing define the pressure chamber and portions of a cover coupled to the housing defining a sensing chamber.

In yet another aspect, the pressure chamber and the sensing chamber are separated by the diaphragm, which is retained between the cover and the housing.

In still a further aspect, a switch activator is provided in the sensing chamber.

In an additional aspect, the switch activator has an end biased by a biasing member in a first direction, the switch activator being configured to move in a second direction opposite of the first direction upon sensing of the ultra-low flow condition.

In still another aspect, a diaphragm defines a portion of the sensing chamber and the switch activator is biased toward the diaphragm.

In yet a further aspect, the switch activator includes a proximal end within the sensing chamber and a distal end located adjacent to the switch and configured to engage the switch.

In an aspect of the invention, an electric tankless water heater for heating a continuous supply of water is provided. The electric tankless water heater includes a heater assembly having a water inlet, a water outlet and a heating chamber defining a water flow path between the water inlet and the water outlet; a temperature sensor configured to measure the temperature of water flowing through the heating chamber of the heater assembly; a flow sensing device configured to detect an ultra-low flow condition of water within the heating chamber of the heater assembly; a heating element located in heating chamber; and a control circuitry coupled to the heating element, the temperature sensor and the flow rate sensor, the control circuitry is configured to control the amount of electrical current flowing through the heating elements in response to the flow condition measured by the flow sensor.

In another aspect, the flow sensing device includes a pressure chamber isolated from a sensing chamber.

In a further aspect, a diaphragm separates the pressure chamber from the sensing chamber.

In an additional aspect, the sensing chamber is in fluid communication with the water flow path between the water inlet and the water outlet.

In yet another aspect, portions of the housing define the pressure chamber and portions of a cover coupled to the housing defining the sensing chamber.

In still a further aspect, the flow sensing device includes a pressure chamber isolated from a sensing chamber and further comprises a switch activator at least partially provided in the sensing chamber.

In an additional aspect, the switch activator includes an end biased by a biasing member in a first direction toward the pressure chamber, the switch activator being configured to move in a second direction opposite of the first direction upon sensing of the ultra-low flow condition.

In still another aspect, the switch activator includes a proximal end within the sensing chamber and a distal end located outside of the sensing chamber and adjacent to the switch, the distal end being configured to engage the switch.

Further objects, features and advantages will become readily apparent to persons skilled in the art after review of the following description with reference to the drawings and the claims that are appended to inform a part of this specification.

BRIEF DESCRIPTION OF THE DRAWINGS

The drawings described herein are for illustrative purposes only of selected configurations and not all possible implementations, and are not intended to limit the scope of the present disclosure.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
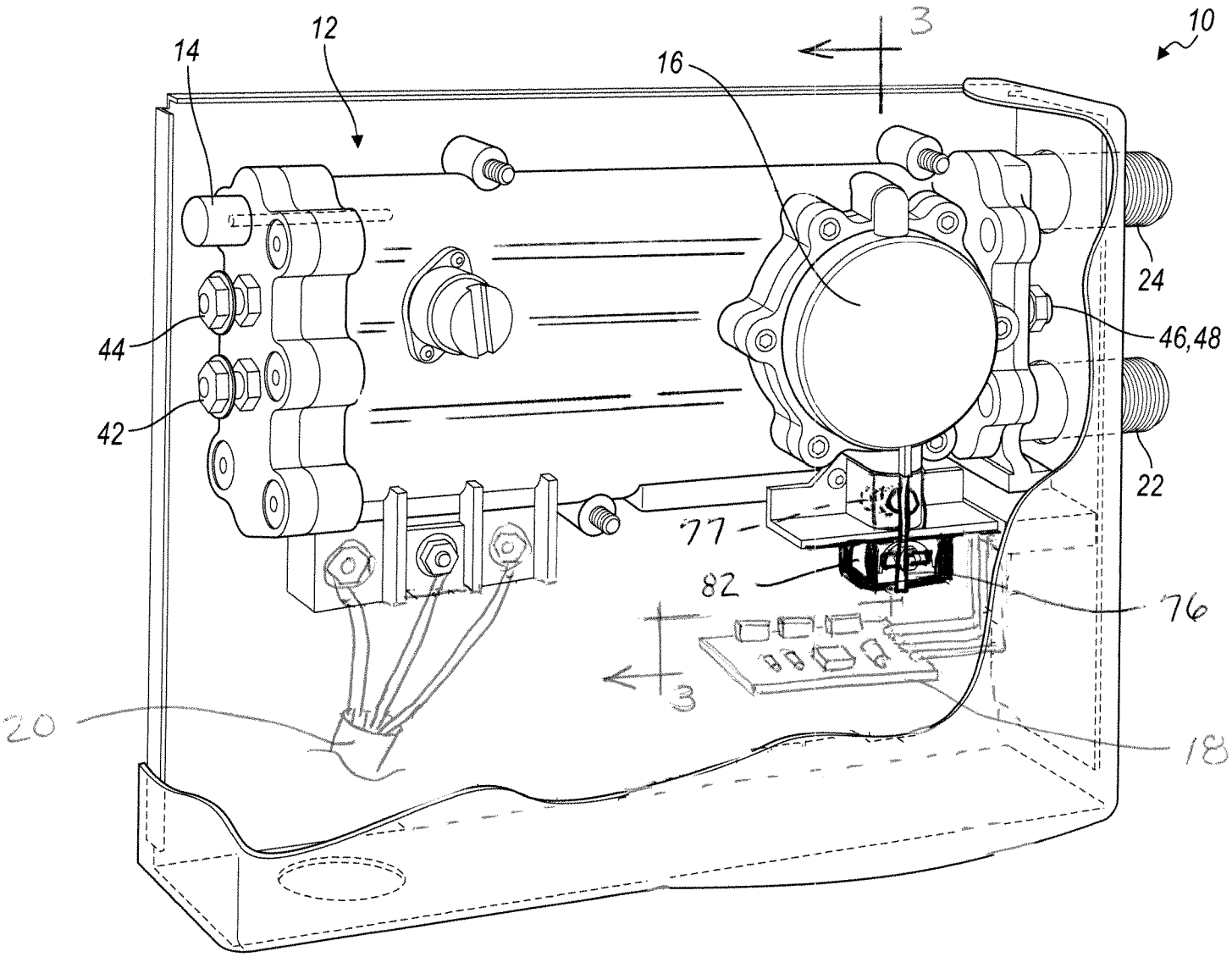
FIG. 1 is a perspective view, with portions broken away, of an electric tankless water heater incorporating the principles of the present disclosure.

Referring now to the drawings, a tankless water heater embodying the principles of the present disclosure is generally illustrated in FIG. 1 and designated at 10. In this regard, while the tankless water heater 10 is generally shown and described herein as being a heater for a continuous water supply, it will be appreciated that the tankless water heater 10 may be used for heating a continuous or intermittent supply of other fluid(s) within the scope of the present disclosure.

Figure 2:
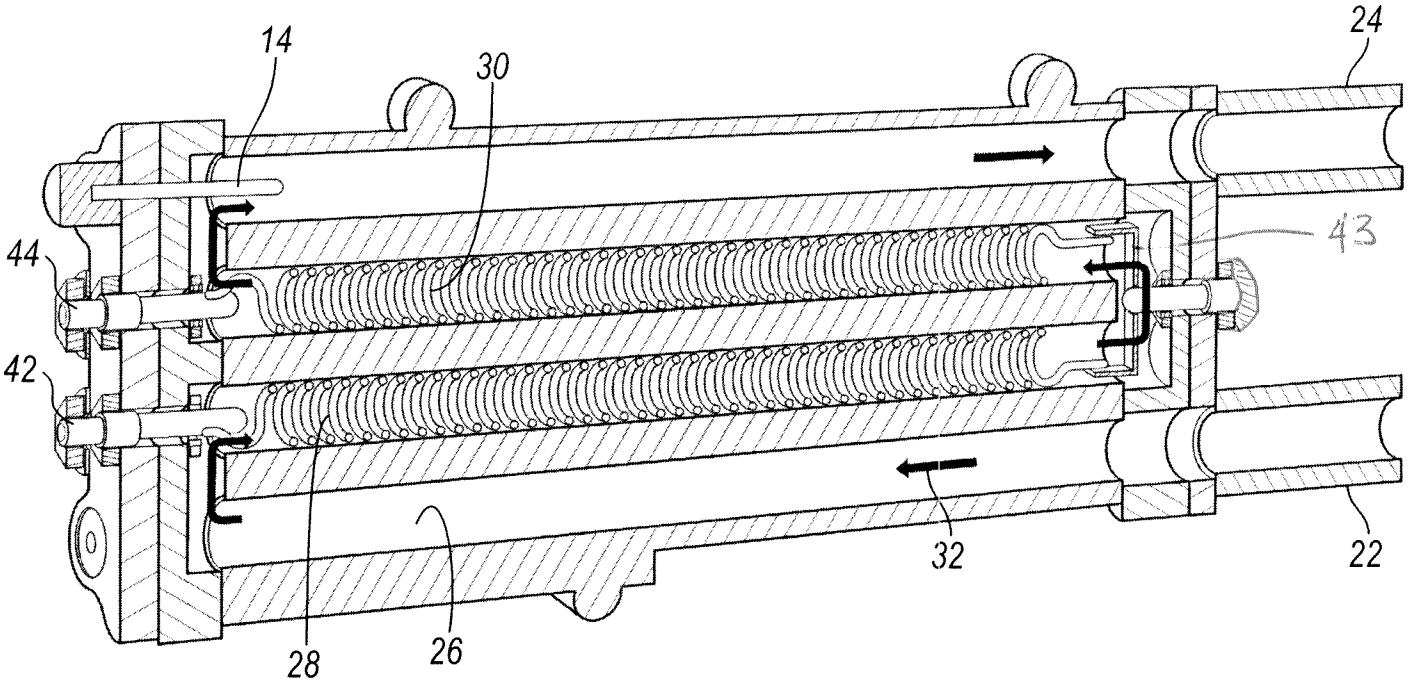
FIG. 2 is a cross-sectional view of a subcomponent, namely an electric heater element assembly, of the tankless water heater seen in FIG. 1.

As illustrated in FIGS. 1, 2, and/or 3, the tankless water heater 10 includes as its principal components a heater assembly 12 including a housing 13, a temperature sensor 14, a flow sensing device 16, control circuitry 18, and a power source 20. The heater assembly 12 further include a fluid inlet 22, a fluid outlet 24, a heating chamber 26, a first heating element 28, and a second heating element 30. The heating chamber 26 defines at least part of a water flow path 32 between the fluid inlet 22 and the fluid outlet 24. As illustrated in FIG. 2, the flow path 32 defines a reverse bend or serpentine shape, and the heating chamber 26 defines a single heating chamber having a reverse bend or serpentine shape extending along its length from the fluid inlet 22 to the fluid outlet 24. While illustrated as having a reverse bend or serpentine shape, the heating chamber 26 may have alternate shapes and configurations depending on the particular application, as well as the overall size and shape of the heater assembly 12. The heating chamber 26 may further define a circular cross-sectional shape along its length from the fluid inlet 22 to the fluid outlet 24. In this regard, the heating chamber 26 may define a constant diameter along the flow path 32.

The first heating element 28 is disposed in the heating chamber 26 and is provided with a first wattage. The wattage of the first heating element 28 will depend on the particular design of the tankless water heater 10. Generally, the wattage may be between 720 Watts and 8550 Watts. The second heating element 30 is also disposed in the heating chamber 26 and may operate up to and including a second wattage. Like the first heating element 28, the wattage of the second heating element 30 will also depend on the particular design of the tankless water heater 10. The second wattage may be the same as or different from the first wattage. Generally, its wattage will also be between 720 Watts and 8550 Watts.

The first and second heating elements 28, 30 are preferably formed of a resistive heating material. In this regard, the first and/or second heating elements 28, 30 may be formed from an electrically conductive material, such as a metallic material (e.g., molybdenum, tungsten, tantalum, niobium, and alloys thereof), for example, through which electricity may flow and provide resistive heat to the heater assembly 12.

In some implementations, one or both of the first and second heating elements 28, 30 may be sheathless. In this regard, the first and/or second heating elements 28, 30 may omit sheathing and coatings, such as a ceramic coating covered by a stainless steel sheath or other coating or cover material. As such, the first and/or second heating elements 28, 30, including the resistive heating material forming at least a part thereof, may be directly disposed within the heating chamber 26 and directly in contact with the fluid flowing through the heating chamber 26.

With reference to FIG. 2, the temperature sensor 14 measures the temperature of the fluid flowing through the heating chamber 26 of the heater assembly 12, and is in communication with the control circuitry 18. In this regard, the temperature sensor 14 is preferably provided in the heater assembly 12 downstream of the heating elements 28, 30, or proximate the fluid outlet 24, to measure the temperature of the fluid as it is about to exit the water heater 10.

The flow sensing device 16 measures a flow condition of fluid along the flow path 32 and within the heating chamber 26 of the heater assembly 12, and is also in communication with the control circuitry 18. The flow sensing device 16 may be coupled to the heater assembly 12 along the flow path 32 or more particularly, as shown, proximate the fluid outlet 24 to measure the flow condition of the fluid flowing along the flow path 32 proximate the fluid outlet 24. As will be explained in more detail below, the flow sensing device 16 communicates the flow condition to the control circuitry 18. As used herein, the flow condition is the flow rate (e.g., gallons per minute) of the fluid flowing along the flow path 32, but may optionally include other parameters of the fluid flow.

The control circuitry 18 is coupled to, or otherwise in communication with, the first heating element 28, the second heating element 30, the temperature sensor 14, and the flow sensing device 16. In this regard, the control circuitry 18 uses signals received from the temperature sensor 14 and/or the flow sensing device 16 to control the operation of the tankless water heater 10. For example, during operation of the tankless water heater 10, and in response to signals received from the temperature sensor 14 and/or the flow sensing device 16, the control circuitry 18 may regulate the amount of electrical current flowing through the first and second heating elements 28, 30.

With reference to FIGS. 1 and 2, the power source 20 may be provided as an alternating current source, such as an 110 v outlet (or higher voltage), a generator or a direct current source, such as a battery, for example. As seen in FIG. 2, the first heater element 28 is coupled to a first pole 42 and is also coupled to the control circuitry 18 at the first pole 42, such that electrical power can be selectively transmitted by the control circuitry 18, through operation of relays, for example, to the first pole 42 and from the first pole 42 to the first heater element 28. The second heater element 30 is illustrated as being connected in series with the opposing end of the first heater element 28 by a coupling 43 and, at the opposing end of the second heating element 30 to a second pole 44. The second heater element 30 is also coupled to the control circuitry 18 via the second pole 44. The control circuitry 18 is a simple control circuit designed to, upon detection of a flow condition, energize the first and second heating elements 28, 30 to provide heated water to the outlet at a predetermined temperature. Such types of control circuitry 18 are well known and within the skill of those in the field of the present invention and, therefore, is not further described herein.

Figure 3:
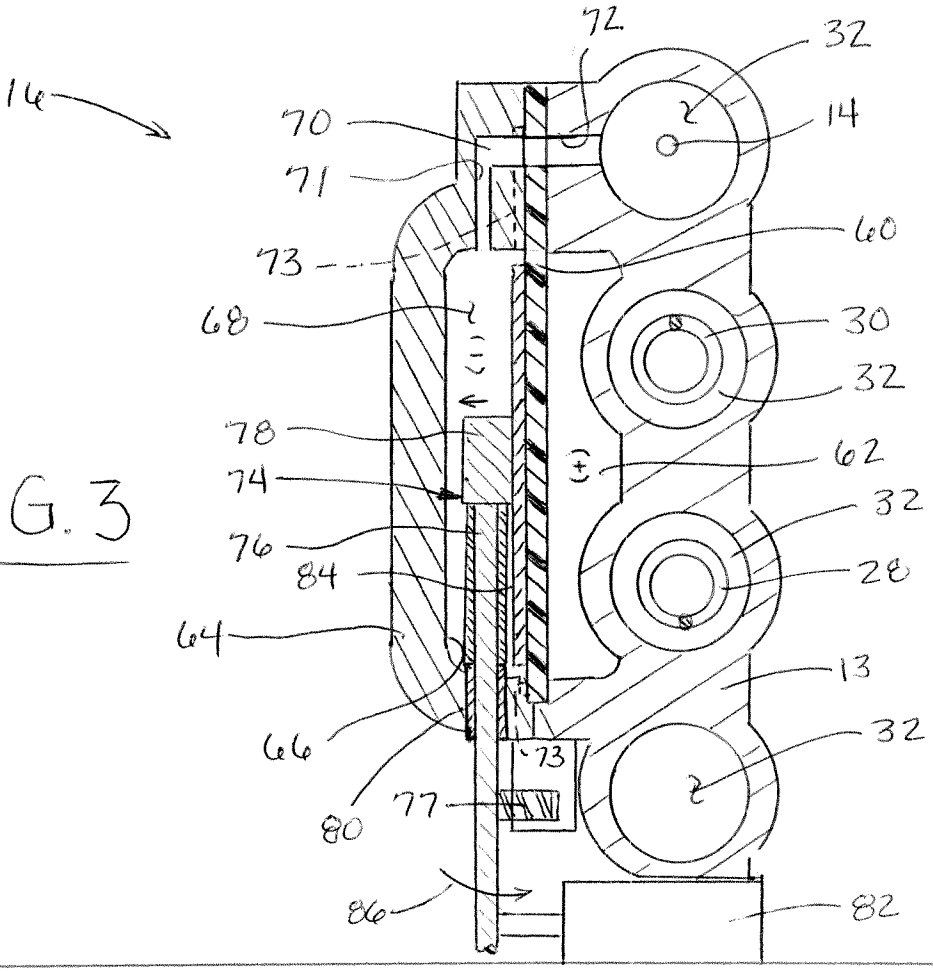
FIG. 3 is a cross-sectional view, generally taken along line 3-3 in FIG. 1, through the flow sensing device of an electric tankless water heater incorporating the principles of the present disclosure.

Referring now to FIG. 3, a cross-section view through the flow sensing device 16 utilized in accordance with the principles of the present invention is illustrated therein. As seen therein, a portion of the housing 13 of the heater assembly 12 forms part of the flow sensing device 16 and cooperates with a diaphragm 60 to define a sealed pressure chamber 62. The diaphragm 60 is retained over the pressure chamber 62 by a cover 64 secured by fasteners (not shown) to the housing 13. Retained in this manner, the diaphragm 60 extends completely about the perimeter of the pressure chamber 62 so as to seal off and isolate a volume of air within the pressure chamber 62. Preferably, the diaphragm 60 is flexible and formed of rubber.

Figure 5:
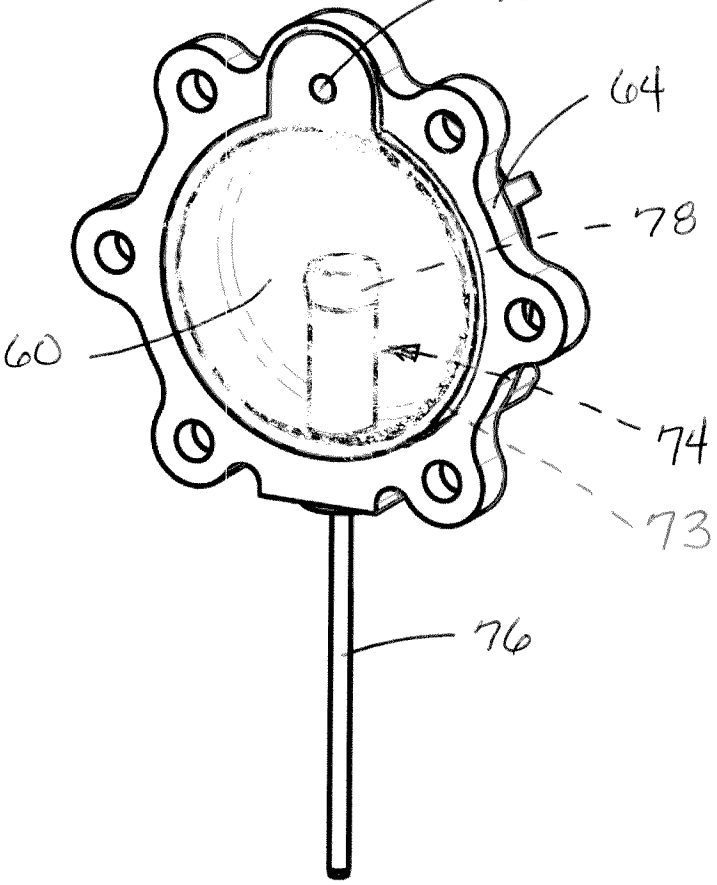
FIG. 5 is an interior perspective view of the of the cover of the flow sensing device, similar to the view of FIG. 4, with the diaphragm installed; and Corresponding reference numerals indicate corresponding parts throughout the drawings.
Figure 4:
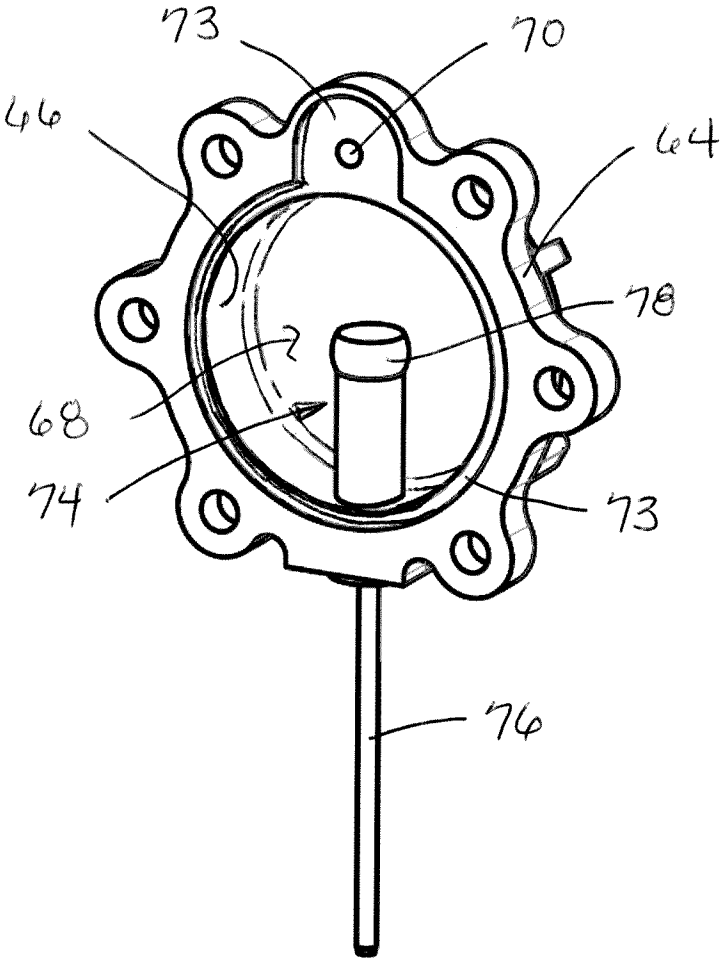
FIG. 4 is an interior perspective view of the of the cover of the flow sensing device removed from the electric tankless water heater of FIG. 1.

The cover 64, which is also illustrated in FIGS. 4 and 5, includes a recess 66 that cooperates with the diaphragm 60 to define a sensing chamber 68 on the side of the diaphragm 62 opposite from the pressure chamber 62. The sensing chamber 68 is in fluid communication with the water traversing the flow path 32 through the heating chamber 26. In one embodiment, the sensing chamber 68 is in communication with the flow path 32 via a port 70, defined in part 71 by the cover 63 and in part 72 by the housing 13. Alternatively, the sensing chamber 68 may be in communication with the flow path 32 with the port 70 being defined in part 72 by the housing and in part by a recessed relief area 73 defined about the perimeter of the recess 66 in the cover 64, in which case the part 71 of the cover 64 is omitted. The relief area 73 is readily seen in FIG. 4 and is show in FIGS. 3 and 5 by dashed lines.

Also provided in the sensing chamber 68 is one end of a switch actuator 74. The switch actuator 74 includes an actuator rod 74 with a proximal end in the sensing chamber 68 and a distal end outside of the chamber 68 and the cover 64. The proximal end of the actuation rod 74 is provided with an actuation knob 78 that is preferably centrally located within the sensing chamber. Where the actuation rod 76 extends through the cover 64, the actuation rod 76 passes through a pivot 80 that forms a fluid tight seal with the cover 64 and the actuation rod 76. The actuation rod 76 is biased such that the proximal end, or more specifically the actuation knob 78, is biased toward the diaphragm 60. In illustrative example, biasing may be achieved by a biasing member 77, such as a coil spring. The pivot 80 allows the actuation rod 76 to pivot in such a manner that when the proximal end of the actuation rod 76 moves toward the cover 64, the distal end of the actuation rod 76 moves in an opposite direction, which causes engagement with and activation of a switch 82. Preferably, the switch 82 is proportional in its operation and provides varying signals to the control circuitry 18 depending on the degree of activation by the activation rod 76.

The flow sensing device 16 may additionally include a rigid activation plate 84 provided in the sensing chamber 68 over the diaphragm 60 to engage and interact with the activation knob 78 on the proximal end of the activation rod 76. The activation plate 84 provides a rigid, smooth and durable surface toward which the activation knob 78 may be biases and over which the activation knob 78 may engage and slide.

During operation of the flow sensing device 16, as the flowing fluid, such as water, moves along the flow path 32 past the port 70 and out of the fluid outlet 27, the flow of liquid draws on the sensing chamber 68 and induces a negative pressure in the sensing chamber 68 relative to the pressure chamber 62. As a result, the diaphragm 60 is biased/caused to deform toward the cover 64. This in turn causes a similar movement of the activation plate 84 and the proximal end of the activation rod 76. As proximal end of the activation rod 76 moves toward the cover 64, the distal end of the activation rod 76 moves to engage the switch 82, designated at 86. The flow sensing device 16 is highly sensitive and capable of initially sensing ultra-low flows, flows above 0.0 GPM and up to 0.4 GPM, and more preferably in the range of about 0.1 to 0.3 gallons per minute.

The switch 82 is optionally proportional so that, depending on the degree of pivot of the activation rod 76, the rate of the liquid flow along the flow path 32 and out of the housing 13 can be similarly determined by the control circuitry 18.

In operation, upon an ultra-low flow of water, the flow of water in the flow path 32 will pass the port enroute to the water outlet 24. This ultra-low flow induces a negative pressure in the port 70 and in the sensing chamber 68. Since the pressure chamber 62 is then at a higher pressure relative to the sensing chamber 68, the diaphragm 60 flexes toward the sensing chamber 68 displacing the activation plate 84 and the proximal end of the switch activator 74. As generally discussed above, the activation rod 76 then pivots about pivot 80, against the force of the biasing member (spring) 77. Moving in the direction of arrow 86, the distal end of the activation rod 76 engages and activates switch 82, causing operation of the control circuitry 18.

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A tankless water heater for heating a continuous supply of water, the tankless water heater comprising:

a heater assembly having a housing with a water inlet, a water outlet and a heating chamber further defining a water flow path between the water inlet and the water outlet;

a temperature sensor configured to measure the temperature of water flowing through the heating chamber of the heater assembly;

a flow sensing device configured to measure a flow condition of water through the flow path within the heater assembly, the flow sensing device including a sensing chamber in fluid communication with the flow path, a diaphragm separating and fluidly isolating a pressure chamber from the sensing chamber and the flow path and preventing fluid communication there between, the flow sensing device configured to induce a relative negative pressure in the sensing chamber at an ultra-low flow rate of 0.2 gallons per minute;

a switch coupled to the flow sensing device;

one or more heating elements located in a heating chamber; and a controller coupled to the switch, the one or more heating elements, the temperature sensor and the flow sensor, the controller configured to regulate the amount of electrical current flowing through the one or more heating elements in response to a flow condition measured by the flow sensing device.

2. The tankless water heater of claim 1, portions of the housing define the pressure chamber and portions of a cover coupled to the housing defining a sensing chamber.

3. The tankless water heater of claim 2, wherein the diaphragm is retained between the cover and the housing.

4. The tankless water heater of claim 1, further comprising a switch activator provided in the sensing chamber.

5. The tankless water heater of claim 4, wherein the switch activator has an end biased by a biasing member in a first direction, the switch activator configured to move in a second direction opposite of the first direction upon sensing of the ultra-low flow condition.

6. The tankless water heater of claim 4, wherein the diaphragm defines a portion of the sensing chamber, the switch activator being biased toward the diaphragm.

7. The tankless water heater of claim 4, wherein the switch activator includes a proximal end within the sensing chamber and a distal end located adjacent to the switch and configured to engage the switch.

8. The tankless water heater of claim 1, wherein the sensing chamber is in fluid communication with the water flow path between the water inlet and the water outlet.

9. The tankless water heater of claim 1, wherein portions of the housing define the pressure chamber and portions of a cover coupled to the housing defining the sensing chamber.

10. The tankless water heater of claim 1, wherein the flow sensing device includes a switch activator at least partially provided in the sensing chamber.

11. The tankless water heater of claim 10, wherein the switch activator includes an end biased by a biasing member in a first direction toward the pressure chamber, the switch activator being configured to move in a second direction opposite of the first direction upon sensing of the ultra-low flow condition.

12. The tankless water heater of claim 10, wherein the switch activator includes a proximal end within the sensing chamber and a distal end located outside of the sensing chamber and adjacent to the switch, the distal end being configured to engage the switch.

* * * * *